US007559806B2

(12) United States Patent
Lin et al.

(10) Patent No.: US 7,559,806 B2
(45) Date of Patent: Jul. 14, 2009

(54) ELECTRICAL CONTACT

(75) Inventors: Chun-Fu Lin, Tu-Cheng (TW); Shih-Wei Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 2 days.

(21) Appl. No.: 11/900,867

(22) Filed: Sep. 13, 2007

(65) Prior Publication Data

US 2008/0064236 A1 Mar. 13, 2008

(30) Foreign Application Priority Data

Sep. 13, 2006 (CN) ..... 2006 2 0076590

(51) Int. Cl.
*H01R 13/24* (2006.01)

(52) U.S. Cl. ..... 439/700; 439/841; 439/289

(58) Field of Classification Search ..... 439/700, 439/841, 289

See application file for complete search history.

(56) References Cited

U.S. PATENT DOCUMENTS 4,385,754 A * 5/1983 Waite ..... 267/71
6,814,626 B2 * 11/2004 Wen-Yao ..... 439/700
2008/0214063 A1 * 9/2008 Hsiao et al. ..... 439/841

* cited by examiner

*Primary Examiner*—Truc T Nguyen
(74) *Attorney, Agent, or Firm*—Wei Te Chung

(57) ABSTRACT

The present invention relates to a contact for electronic devices. The contact includes an upper contact, a lower contact, which includes a contact portion, a lower contact coupled to the upper contact, and a spring fitted over a predetermined area between the upper contact and lower contact. The lower contact includes a second supporting portion, two elastic parts extending from the second supporting portion and provided with opposite to each other. A channel is defined by the two elastic parts of the lower contact, and provides a space to allow movement of the contact portion of the upper contact therein, when the upper contact is coupled to the lower contact. When the upper contact is coupled to the lower contact, the contact portion of the upper contact is insert into the channel defined by the two elastic parts of the lower contact. Thereby, the contact portion is in close contact with the retaining portion, and so an efficient and a short transmitted between two contacts is established.

16 Claims, 4 Drawing Sheets

ELECTRICAL CONTACT

BACKGROUND OF THE INVENTION

1. Field of the Invention

The present invention relates generally to a contact for electronic devices, and more particularly to a contact for electronic device which electrically connects a plurality of leads of an integrated circuit (IC) provided in a test socket to the corresponding pads of a printed circuit board (PCB).

2. Background of the Invention

U.S. Pat. No. 7,025,602B1 disclosed a test socket receiving a ball grid array-type semiconductor IC and including a cover, a latch and a socket body.

The cover is compressed against and is in close contact with the IC to be tested, thus forcing the IC to be in close contact with an upper contact part of a conventional contact which is positioned under the IC.

The conventional contact (called a pogo pin) is positioned under the IC to be tested in the test socket, and includes an upper contact pin, a lower contact pin, a coil spring, and a body. The body surrounds the two contact pins to prevent the removal of the contact pins and, and has the coil spring therein to provide elasticity to the contact pins and, thus allowing the contact pins and to move in a vertical direction.

The two contact pins are generally made form copper alloy material, and the boy is generally machined and gold-plated from a copper alloy material having a pipe shape. Generally, it is preferable that an electrical signal of the contact flow from the upper contact pin through the inner surface of the body to the lower contact pin. Since the electrical signal flows in this way, the electrical signal transmission distance becomes short, thus precisely indicating electrical properties.

Assuming that an electrical contact between the two contact pins and the inner surface of the body is poor, the electrical signal does not flow through the body but flows through the spring. In this case, the signal transmission distance is increased. Consequently, the contact cannot efficiently perform its function.

The conventional contact is problematic in that the length (3.0 mm) of the body is larger than the inner diameter (0.3 mm) of the body, and the plating state of the body is poor, so that an electrical signal is not satisfactorily transmitted between the two contact pins. Further, as the contact is repeatedly used, debris generated by abrasion is caught between the contact pins and, and the body, thus deteriorating electrical contact capacity. Further, the conventional contact is problematic in that the contact requires a greater number of components, so that it is difficult to assemble the components, thus productivity is low. Furthermore, manufacturing costs are high due to a large amount of machining work.

In view of the foregoing, a new and improved electrical contact is desired to solve above-mentioned problems.

SUMMARY OF THE INVENTION

Accordingly, an object of the present invention is to provide a electrical contact for electronic devices, capable of efficiently transmitting an electrical signal from an upper contact to a lower contact.

Another object of the present invention is to provided a contact, which reduces the number of components, thus enhancing productivity, affording constant quality, and realizing mass production at low cost.

To achieve the above-mentioned objects, an electrical contact is provided having an upper contact, a lower contact and a spring. The upper contact comprises a first supporting portion, a contact part and a contact portion extending from the supporting portion, respectively. The lower contact is coupled to the upper contact to be parallel to the upper con tact, the lower contact and includes a second supporting portion, two elastic parts contacting the second supporting portion and provided with opposite to each other. The spring is fitted over a predetermined area between the upper contact and lower contact. A channel is defined by the two elastic parts of the lower contact, and provides a space to allow movement of the contact portion of the upper contact therein, when the upper contact is coupled to the lower contact.

When the upper contact is coupled to the lower contact, the contact portion of the upper contact is insert into the channel defined by the two elastic parts of the lower contact. Thereby, the contact portion is in close contact with the retaining portion, and so an efficient and a short transmitted between two contacts is established.

DETAILED DESCRIPTION OF THE PREFERRED EMBODIMENT OF THE INVENTION

Hereinafter, the present invention will be described in detail with reference to the accompanying drawings.

Figure 2:
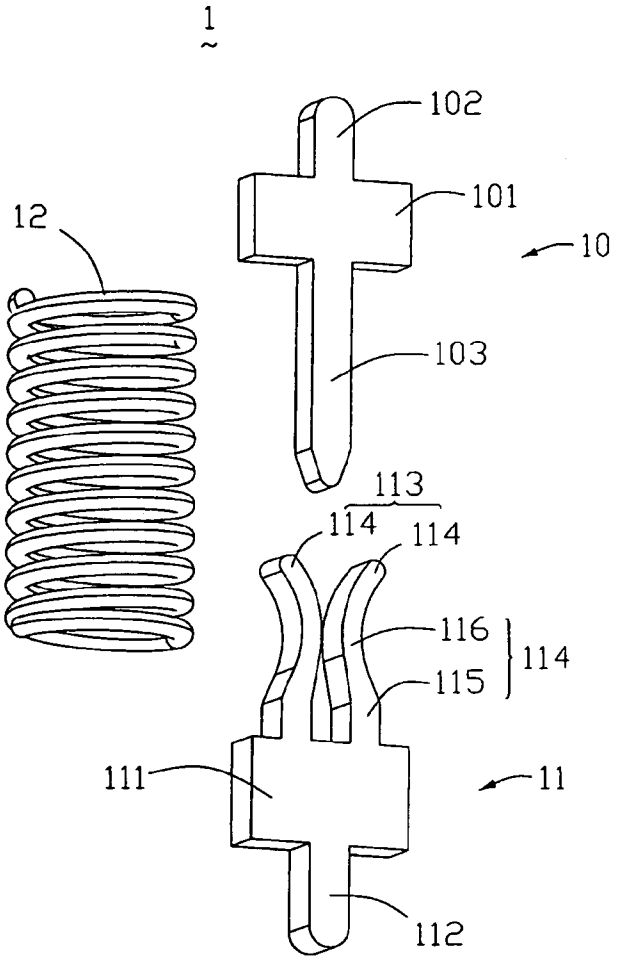
FIG. 2 is an exploded view of the contact of FIG. 1.
Figure 1:
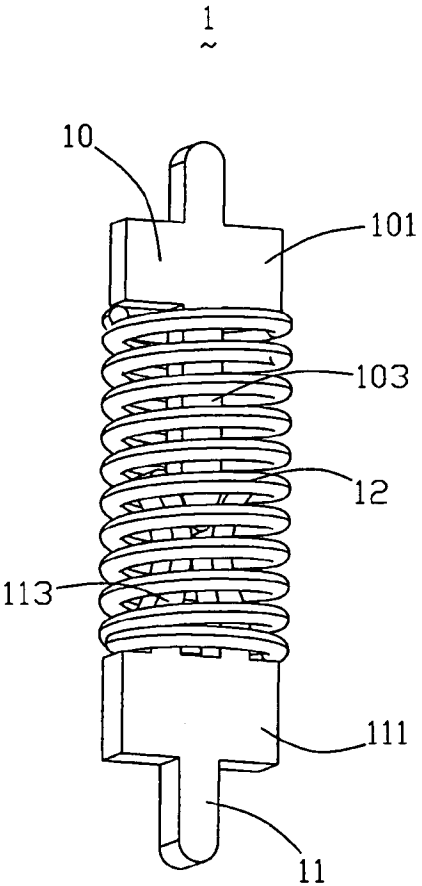
FIG. 1 is an assembly view of a contact in accordance with present invention.

Referring to FIGS. 1-2, a contact 1 for an electronic device (not shown) includes an upper contact 10, a lower contact 11 coupled to the upper contact 10 and a spring 12 fitted over a predetermined area between the upper contact 10 and the lower contact 11. The upper, lower contacts 10, 11 are formed from metal material in a slice shape, and are coupled to be aligned in a same plane to each other or parallel to each other.

The upper contact 10 includes a first supporting portion 101, a first contact part 102 extending from the top end of the first supporting portion 101 and contacting a lead of an object (not shown) to be tested, and a contact portion 103 extending from the bottom end of the first supporting portion 101. The first supporting portion 101 is of a plate-like configuration having a rectangle shape.

The lower contact 11 comprises a second supporting portion 111, a second contact part 112 extending from one end of the second supporting portion 111, and an elastic portion 113 extending form the other end of the second supporting portion 112. The elastic portion 113 includes two elastic parts 114 extending from the second supporting 111 and provided to be symmetrical with respect to each other. The two elastic parts 114 each comprises an extending portion 115 contacting the second supporting portion, and a retaining portion 116 extending from said extending portion 115, wherein the two retaining portions 116 is formed a approximate hyperbola shape together. A channel is defined by the two elastic parts 114 of the lower contact 11, and provides a space to allow movement of the contact portion 103 of the upper contact 10 therein, when the upper contact 10 is coupled to the lower contact 11. The least distance of the channel defined by the two elastic parts 114 is slightly smaller than width of the contact portion 103 of the upper contact 10, thus, forcing the contact portion 103 to be in close contact with the two retaining portions 116, when the upper contact 10 is coupled to the lower contact 11.

The spring 12 is fitted over a predetermined area between the upper and lower contacts 10,11, and will not be described in detail herein.

In an assembly process, first, the spring 12 is fitted over a predetermined area between the upper and lower contacts 10,11. The upper and lower contacts 10,11 are aligned in a same plane to each other or parallel to each other.

Thereafter, the contact portion 103 of the upper contact 10 is inserted into the channel defined by the two elastic parts 114 of the lower contact 11 until the first supporting portion 101 of the upper contact is stopped by the spring 12. Thereby, the assembly is completed.

At this time, the spring 12 is compressed to some extent. According to the intended purpose of the contact 1, the compression force of the spring 12 is appropriately designed.

For the efficient assembly of the contact 1, that is, for mass production, a contact 1 having proper dimensions may be used or an automatic assembling machine may be developed to maximize the efficiency of the production.

The operation of the contact 1 for the electronic device, according to this invention, which is assembled through the above-mentioned method will be described.

As set forth foregoing, when the upper contact 10 is coupled to the lower contact 11, the contact portion 103 of the upper contact 10 is inserted into the channel defined by the two elastic parts 114 of the lower contact 11. Thereby, the contact portion 103 is in close contact with the two retaining portions 116, and so an efficient and a short transmitted between two contacts 10,11 is established.

Figure 4:
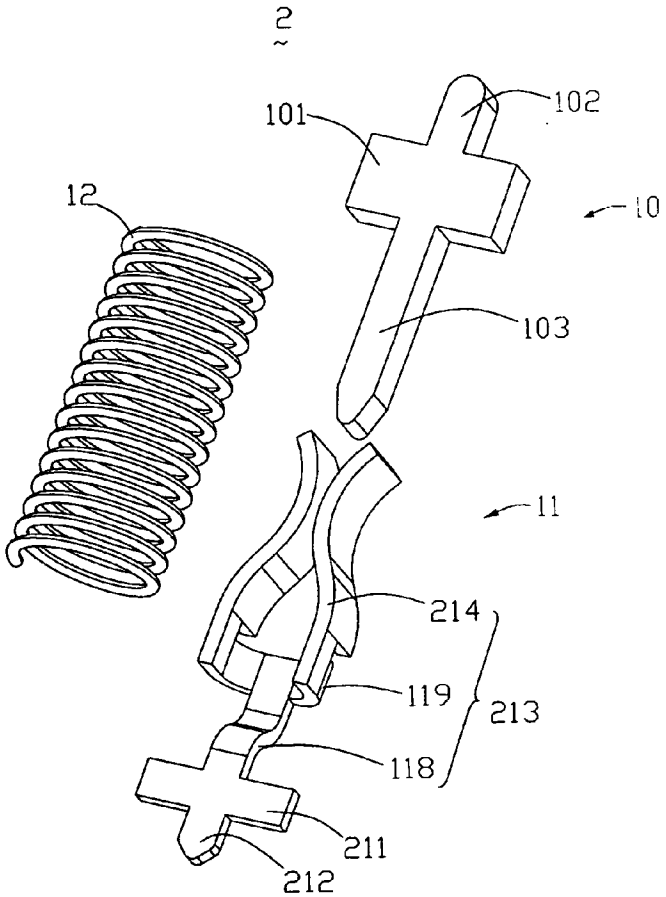
FIG. 4 is an exploded view of the contact of FIG. 3.
Figure 3:
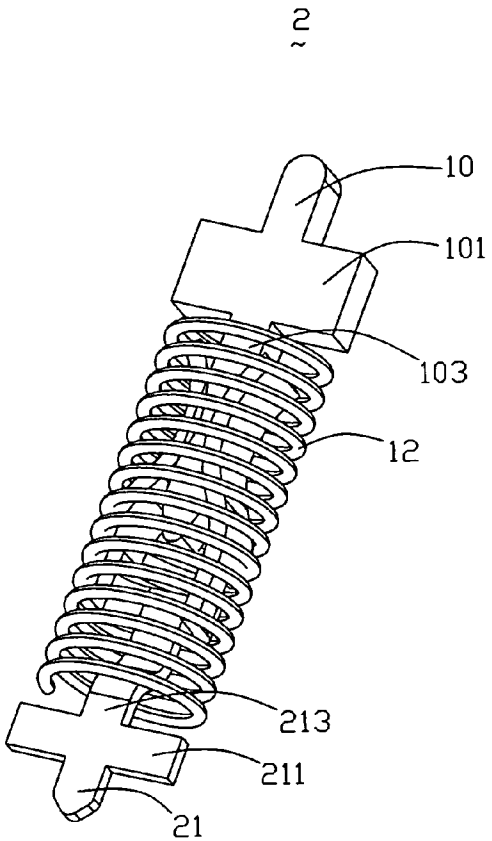
FIG. 3 is an assembly view of a contact in accordance with a second embodiment of the present invention.

FIGS. 3-4 shows a contact 2 in accordance with the second embodiment of the present invention. The contact 2 according to the second embodiment includes an upper contact 10, a lower contact 21, and a spring 12 fitted over a predetermined area between the upper and lower contact 10,21, wherein the upper contact 10 has no changes, and the lower contact 21 is similar to the lower contact 11 of the contact 1 in accordance with the first embodiment of this invention but has some difference in configuration comparing with the lower contact 11.

The lower contact 21 includes a second supporting portion 211, a second contact part 212 extending from one end of the second supporting portion 211, and an elastic portion 213 extending form the other end of the second supporting portion 211. The elastic portion 213 includes a body 119 having a curve shape, a pair of elastic parts 214 extending from two opposite ends of the body 119 and provided to be symmetrical with respect to each other, and a curved portion 118 extending from the second supporting 211 and contacting the body 119 and being disposed between the body 119 and the second supporting portion 111 of the lower contact 11. A channel is defined by the two elastic parts 214 of the lower contact 21, and provides a space to allow movement of the contact portion 103 of the upper contact 10 therein, when the upper contact 10 is coupled to the lower contact 21. The least distance of the channel defined by the two elastic parts 214 is slightly smaller than width of the contact portion 103 of the upper contact 10, thus, forcing the contact portion 103 to be in close contact with the two elastic parts 214, when the upper contact 10 is coupled to the lower contact 21.

The spring 12 is fitted over a predetermined area between the upper and lower contacts 10,21, and will not be described in detail herein.

Figure 6:
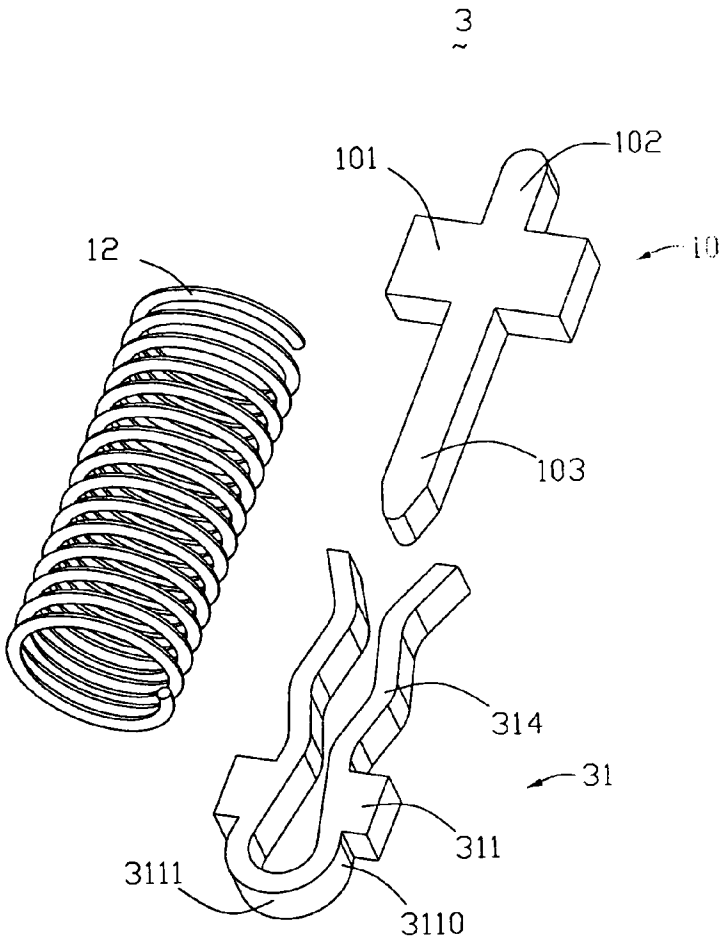
FIG. 6 is an exploded view of the contact of FIG. 5
Figure 5:
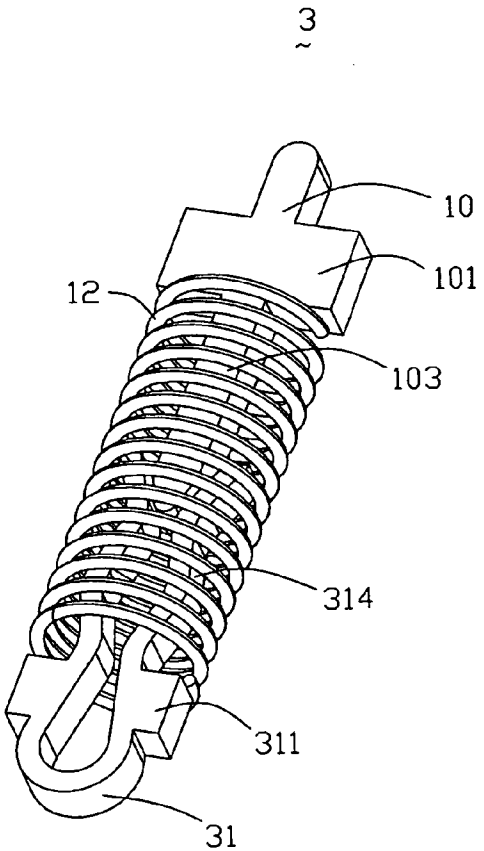
FIG. 5 is an assembly view of a contact in accordance with a third embodiment of the present invention.

Reference is now made to FIG. 5 and FIG. 6; a contact 3 in accordance with the third embodiment of the present invention is shown. The contact 3 according to the third embodiment includes an upper contact 10, a lower contact 31, and a spring 12 fitted over a predetermined area between the upper and lower contact 10,31, wherein the upper contact 10 has no changes, and the lower contact 31 is similar to the lower contact 11 of the contact 1 in accordance with the first embodiment of this invention but has some difference in configuration comparing with the contact 1 according the first embodiment.

The lower contact 31 includes a second supporting portion 311, a connecting portion 3110 extending from the second supporting portion 311, and two elastic parts 314 extending form the second supporting portion 311. The second supporting portion 311 comprises two parts spacing from each other. The two parts of the second supporting portion 311 each is disposed on exterior side of one elastic part 314 but not in a same elastic part, and two parts is provided to be symmetrical with respect to each other, and the two parts of the second supporting portion 311 and the two elastic are arranged in a same surface or parallel to each other. The two elastic parts 314 is coupled together by the connecting portion 3110 having a curve shape, and like-wise for the two parts of the second supporting portion 311, wherein the top end of the connecting portion 3110 defines a contacting area 3111. A channel is defined by the two elastic parts 314 of the lower contact 31, and provides a space to allow movement of the contact portion 103 of the upper contact 10 therein, when the upper contact 10 is coupled to the lower contact 31.

The least distance of the channel defined by the two elastic parts 314 is slightly smaller than width of the contact portion 103 of the upper contact 10, thus, forcing the contact portion 103 to be in close contact with the two elastic parts 314, when the upper contact 10 is coupled to the lower contact 31.

The spring 12 is fitted over a predetermined area between the upper and lower contacts 10,31, and will not be described in detail herein.

Figure 8:
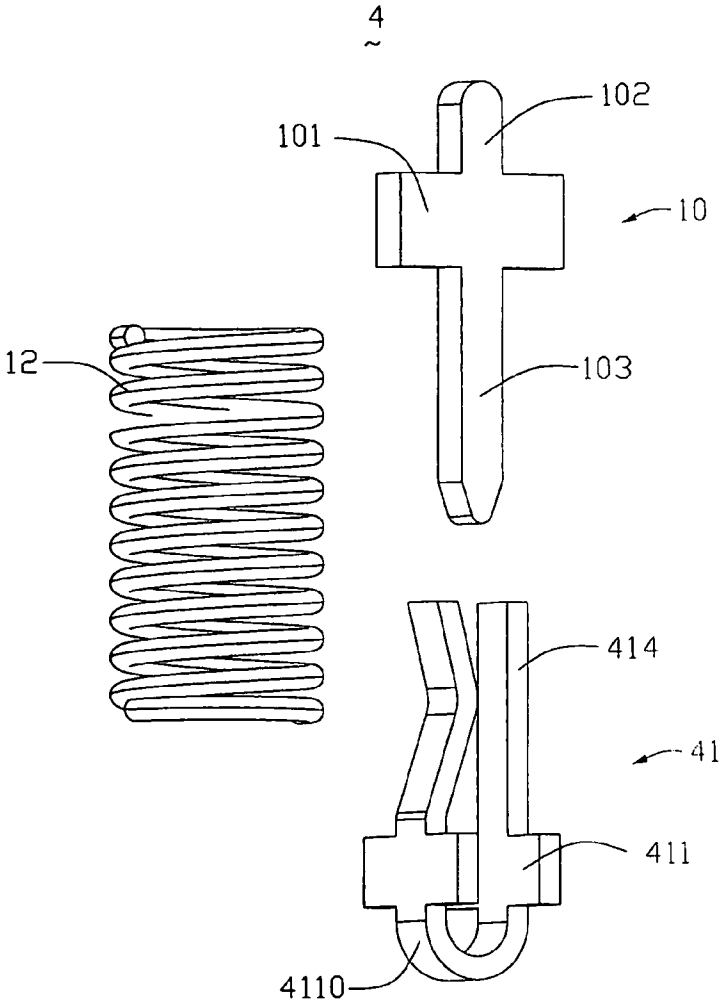
FIG. 8 is an exploded view of the contact of FIG. 7.
Figure 7:
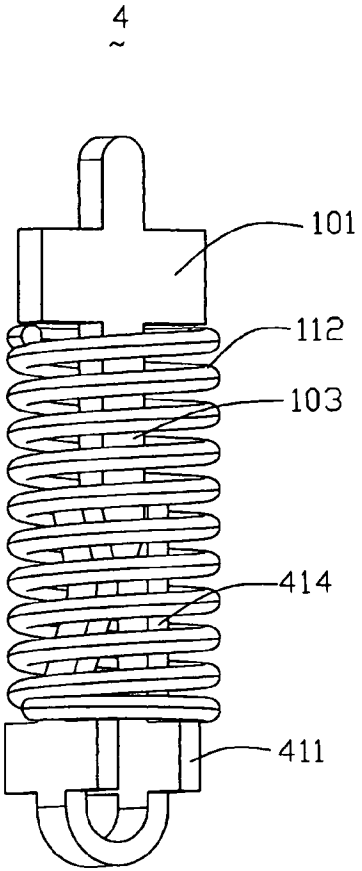
FIG. 7 is an assembly view of a contact in accordance with a fourth embodiment of the present invention.

Referring to FIGS. 7-8, a contact 4 according to the fourth embodiment of the present invention is shown. The contact 4 includes an upper contact 10, a lower contact 41, and a spring 12 fitted over a predetermined area between the upper and lower contact 10,41, wherein the lower contact 41 is similar to the lower contact 31 of the contact 3 in accordance with the third embodiment of this invention but has some difference in configuration comparing with the lower contact 31 of contact 3.

The lower contact 41 includes a second supporting portion 411, a connecting portion 4110 extending from the second supporting portion 411, and two elastic parts 414 extending from the second supporting portion 411. The second supporting portion 411 is arranged vertical to the two elastic parts 414. The second supporting portion 411 could be regard as four parts spacing from each other. The two elastic parts 414 each has two parts on exterior sides, and the two parts of the second supporting portion in a same elastic part is provided to be symmetrical with respect to each other. The separated parts of the second supporting portion 411 on first one of the two elastic 414 is disposed at a predetermined area corresponding to the remainder disposed on the second one of the two elastic parts. A channel is defined by the two elastic parts 414 of the lower contact 41, and provides a space to allow movement of the contact portion 103 of the upper contact 10 therein, when the upper contact 10 is coupled to the lower contact 41.

Further, the two elastic parts 414 is arranged in an asymmetrical manner, wherein first one of the two elastic part 414 extends from the second supporting portion 411 of the lower contact 41 along sole direction vertical to the second supporting portion 411 and the second one of the two elastic parts 414 extends from the second supporting portion 411 toward the first one at first and then extends aloof from the first one.

What is claimed is:

1. An electrical contact comprising:

a lower portion having a repeling portion;

an upper portion slightly sits onto the repeling portion of the lower portion; and a spring positioned surrounding the repeling portion, fitted over a predetermined area between the upper portion and lower portion to urge the upper portion and lower to move in opposite directions;

wherein the reveling portion includes a flexible beam portion, forming divergent portions to receive the upper portion;

wherein the lower portion includes a second supporting portion, the flexible beam portions including, two elastic parts extending from the second supporting portion and being provided with opposite to each other;

wherein the upper portion comprises a first supporting portion, a contact part and a contact portion extending from the first supporting portion, respectively;

wherein the two elastic parts defines a channel, which provides a space to allow movement of the contact portion of the upper portion, when the upper portion is coupled to the lower portion.

2. The electrical contact as claimed in claim 1, the spring extending exteriorly around said contact portion and flexible beam portion, and between said first and second supporting portions to urge upper portion and lower to move in opposite directions.

3. The electrical contact as claimed in claim 2, wherein the elastic parts each includes a extending portion and a retaining portion extending from the extending portion.

4. The electrical contact as claimed in claim 3, wherein the retaining portion of the two elastic parts defines a hyperbolic configuration together.

5. The electrical contact as claimed in claim 2, wherein the two elastic parts is provided to be symmetrical with respect to each other.

6. The electrical contact as claimed in claim 2, wherein the two elastic parts is arranged in an asymmetrical manner.

7. The electrical contact as claimed in claim 6, wherein first one of the two elastic parts extends from the second supporting portion of the lower portion along sole direction vertical to the second supporting portion.

8. The electrical contact as claimed in claim 7, wherein the second one of the two elastic parts extends from the second supporting toward the first one at first and then extends aloof from the first one.

9. The electrical contact as claimed in claim 4, wherein the second supporting portion including two separated parts.

10. The electrical contact as claimed in claim 9, wherein the two parts of the second supporting portion each is disposed on exterior side of one elastic part but not in a same elastic, and the two parts is provided to be symmetrical with respect to each other.

11. An electrical contact comprising;

an upper part having an upper contacting end, a lower mating end a first supporting portion;

a lower part having an upper mating end, a lower mounting end and a second supporting portion; and a spring positioned between and respectively contacting the first supporting portion and the second supporting portion so as to exert an urgent force to push the upper part and the lower part away from each other when the upper part and the lower part forcibly approach each other;

wherein said lower mating end and of the upper part and said upper mating end of the lower part mechanically and electrically engaged with each other when the upper part and the lower part approach each other under compression of said spring;

wherein the upper mating end includes a flexible beam portion, forming divergent portions to receive the lower mating end;

wherein the flexible beam portions including two elastic parts extending from the second supporting portion and being provided with opposite to each other;

wherein the two elastic parts defines a channel, which provides a space to allow movement of the lower mating end of the upper part, when the upper part is coupled to the lower part.

wherein the spring surrounds the upper mating end of the lower part.

12. The electrical contact as claimed in claim 11, wherein said spring is discrete from both of said upper part and said lower part.

13. The electrical contact as claimed in claim 11, wherein the spring surrounds both the upper mating end of the lower part and the lower mating end of the upper part.

14. The electrical contact as claimed in claim 11, wherein the upper contacting end and the lower mating end of the upper part respectively extend from the first supporting portion oppositely.

15. The electrical contact as claimed in claim 14, wherein the lower contacting end and the upper mating end of the lower part respectively extend from the second supporting portion oppositely.

16. An electrical contact comprising:

an upper part having an upper contacting end and a lower mating end;

a lower part having an upper mating end and a lower mounting end; and a spring positioned between and contacting the upper part and a lower part so as to exert an urgent force to push the upper part and the lower part away from each other when the upper part and the lower part forcibly approach each other;

wherein said lower mating end and of the upper part and said upper mating end of the lower part mechanically and electrically engaged with each other when the upper part and the lower part approach each other under compression of said spring; wherein the spring surrounds both the upper mating end of the lower part and the lower mating end of the upper part;

wherein the upper mating end includes a flexible beam portion, forming divergent portions to receive the lower mating end;

wherein the flexible beam portions including two elastic parts extending from the second supporting portion and being provided with opposite to each other;

wherein the two elastic parts defines a channel, which provides a space to allow movement of the lower mating end of the upper part, when the upper part is coupled to the lower part.

* * * * *